US009130289B2

(12) United States Patent
Leiba

(10) Patent No.: US 9,130,289 B2
(45) Date of Patent: Sep. 8, 2015

(54) POWER CONNECTOR

(75) Inventor: Aaron Leiba, San Francisco, CA (US)

(73) Assignee: Google Inc., Mountain View, CA (US)

( * ) Notice: Subject to any disclaimer, the term of this patent is extended or adjusted under 35 U.S.C. 154(b) by 129 days.

(21) Appl. No.: 13/565,570

(22) Filed: Aug. 2, 2012

(65) Prior Publication Data

US 2014/0036421 A1 Feb. 6, 2014

(51) Int. Cl.

| | |
|---|---|
| ***H01R 13/24*** | (2006.01) |
| ***H01R 13/20*** | (2006.01) |
| *H01R 103/00* | (2006.01) |
| *H01R 24/38* | (2011.01) |

(52) U.S. Cl.

CPC ..... *H01R 13/20* (2013.01); *H01R 13/2421* (2013.01); *H01R 24/38* (2013.01); *H01R 2103/00* (2013.01)

(58) Field of Classification Search

CPC .... H01R 13/18; H01R 13/20; H01R 13/2421; H01R 13/6315; H01R 13/65802; H01R 13/65805; H01R 24/58; H01R 43/24

USPC ..... 439/247, 593, 604, 606, 607.02, 668, 439/700, 823, 931

See application file for complete search history.

(56) References Cited

U.S. PATENT DOCUMENTS

| | | | | |
|---|---|---|---|---|
| 3,644,867 | A * | 2/1972 | Krause | 439/101 |
| 4,824,400 | A * | 4/1989 | Spinner | 439/578 |
| 4,834,677 | A * | 5/1989 | Archang | 439/660 |
| 4,993,975 | A | 2/1991 | Asick et al. | |
| 5,154,628 | A * | 10/1992 | Skegin | 439/336 |
| 5,278,725 | A | 1/1994 | Konno et al. | |
| 5,509,823 | A * | 4/1996 | Harting et al. | 439/607.17 |
| 5,743,758 | A * | 4/1998 | Cheng et al. | 439/419 |
| 5,751,544 | A | 5/1998 | Song | |
| 5,771,540 | A | 6/1998 | Carpenter et al. | |
| 5,775,952 | A * | 7/1998 | Lu | 439/668 |
| 5,938,465 | A * | 8/1999 | Fox, Sr. | 439/350 |
| 6,033,248 | A * | 3/2000 | Lyons | 439/257 |
| 6,322,380 | B1 * | 11/2001 | Conroy | 439/188 |

(Continued)

FOREIGN PATENT DOCUMENTS

| | | | |
|---|---|---|---|
| DE | 19620856 | A1 | 11/1996 |
| WO | 03005493 | A1 | 1/2003 |

(Continued)

OTHER PUBLICATIONS

Search Report and Written Opinion for International Application No. PCT/US2013/053027, mailed Oct. 21, 2013, 14 pages (Continued)

*Primary Examiner* — Thanh Tam Le

(74) *Attorney, Agent, or Firm* — Brake Hughes Bellermann LLP

(57) ABSTRACT

An apparatus may include a conductive wire and a plug. The plug may be electrically and mechanically coupled to the conductive wire. The plug may include a non-conductive overmold, an electrically conductive barrel, and a lip. The non-conductive overmold may surround the conductive wire. The electrically conductive barrel may extend from the overmold, and may have a width that is smaller than a width of the overmold. The lip may extend from the barrel in a direction substantially perpendicular to a direction in which the barrel extends from the overmold. A distance from an outer portion of the lip to an opposite outer portion of the lip may be at least twice a length that the barrel extends from the overmold.

18 Claims, 7 Drawing Sheets

(56) References Cited

U.S. PATENT DOCUMENTS

| | | | | |
|---|---|---|---|---|
| 6,481,057 | B2 | 11/2002 | Lin | |
| 6,491,534 | B1 * | 12/2002 | Bonard et al. | 439/188 |
| 6,652,305 | B1 * | 11/2003 | DiFusco | 439/255 |
| 6,682,356 | B2 * | 1/2004 | Tucker et al. | 439/108 |
| 6,749,450 | B1 * | 6/2004 | Chen | 439/188 |
| 6,855,003 | B1 * | 2/2005 | Wyant | 439/502 |
| 6,869,315 | B2 * | 3/2005 | Nakai et al. | 439/668 |
| 7,055,215 | B1 | 6/2006 | Ligtenberg et al. | |
| 7,114,966 | B2 * | 10/2006 | Cecchi | 439/88 |
| 7,121,891 | B2 * | 10/2006 | Cherian | 439/615 |
| 7,351,098 | B2 * | 4/2008 | Gladd et al. | 439/578 |
| 7,361,061 | B2 * | 4/2008 | Kim | 439/668 |
| 7,462,052 | B2 * | 12/2008 | Karton | 439/236 |
| 7,645,143 | B2 | 1/2010 | Rohrbach et al. | |
| 7,984,532 | B2 | 7/2011 | Huang | |
| 8,091,178 | B2 | 1/2012 | Degner et al. | |
| 8,273,028 | B2 * | 9/2012 | Harshman et al. | 600/463 |
| 8,428,288 | B2 * | 4/2013 | Lim | 381/384 |
| 8,556,664 | B2 * | 10/2013 | Aase | 439/668 |
| 2007/0186382 | A1 | 8/2007 | Huang | |
| 2009/0029589 | A1 | 1/2009 | Conner et al. | |
| 2010/0124853 | A1 | 5/2010 | Hsu et al. | |
| 2011/0053411 | A1 | 3/2011 | Zuinen et al. | |
| 2011/0163256 | A1 | 7/2011 | Seitter et al. | |
| 2013/0115821 | A1 | 5/2013 | Golko et al. | |

FOREIGN PATENT DOCUMENTS

| | | | |
|---|---|---|---|
| WO | 2004097995 | A1 | 11/2004 |
| WO | 2011/163256 | A1 | 12/2011 |

OTHER PUBLICATIONS

"Bare PCB Test Probes", Datasheet, Feb. 16, 2012, 1 page.

Schock, "How to Fix a Wobbly Macbook Pro Screen", retrieved from schock.net/articles/2012/02/20/how-to-fix-a-wobbly-macbook-pro-screen/, Feb. 20, 2012, 4 pages.

International Preliminary Report on Patentability for PCT Patent Application No. PCT/US2013/053027, mailed on Feb. 12, 2015, 11 pages.

Office Action for CN Application No. 201390000727.9, mailed Apr. 27, 2015, 3 pages.

* cited by examiner

POWER CONNECTOR

TECHNICAL FIELD

This description relates to power connectors.

BACKGROUND

Power connectors can be used to power electrical devices, such as laptop computers. When the electrical device is located in an ad hoc fashion, such as on a table some distance from an electrical power outlet, the extension of the power connector from the electrical device to the electrical power outlet can become a hazard. The cord of the power connector can extend in such a manner that a person may trip over, or drag, the power connector, pulling the power connector and electrical device off of the table and onto the floor, where the electrical device may break.

SUMMARY

According to one general aspect, an apparatus may include a conductive wire and a plug. The plug may be electrically and mechanically coupled to the conductive wire. The plug may include a non-conductive overmold, an electrically conductive barrel, and a lip. The non-conductive overmold may surround the conductive wire. The electrically conductive barrel may extend from the overmold, and may have a width that is smaller than a width of the overmold. The lip may extend from the barrel in a direction substantially perpendicular to a direction in which the barrel extends from the overmold. A distance from an outer portion of the lip to an opposite outer portion of the lip may be at least twice a length that the barrel extends from the overmold.

According to another general aspect, an electrical device may include a housing, a power input, and at least two retention nodes. The housing may form a recess configured to receive a plug. The housing may include walls surrounding the recess and a base closing one end of the recess. A width of the recess from one wall to an opposite wall may be at least twice a depth of the recess from the base to an opposite end of the recess. The power input may be at the base extending into the recess, and may be coupled to a first node of a power source of the electrical device. The retention nodes may be flexible and conductive. The retention nodes may extend from opposite walls of the housing into the recess. The retention nodes may be coupled to a second node of the power source of the electrical device.

According to another general aspect, an apparatus may include a power cord and an electrical receptacle. The power cord may include a conductive wire, and a plug. The plug may be electrically and mechanically coupled to the conductive wire. The plug may include a non-conductive overmold surrounding the conductive wire, an electrically conductive barrel extending from the overmold, the barrel having a width that is smaller than a width of the overmold, and a lip extending from the barrel in a direction substantially perpendicular to a direction in which the barrel extends from the overmold. The electrical receptacle may include a housing, a power input, and at least two retention nodes. The housing may form a recess receiving the plug. The housing may include walls surrounding the recess and a base closing one end of the recess. A width of the recess from one wall to an opposite wall may be at least twice a depth of the recess from the base to an opposite end of the recess. The power input may be at a base of the recess. The power input may be coupled to a first node of a power source of the electrical device. The retention nodes may be flexible and conductive and extend from opposite walls of the housing into the recess. The retention nodes may be coupled to a second node of the power source of the electrical device. A distance from an outer portion of the lip to a portion of the barrel which is farthest from the outer portion of the lip may be less than or equal to the width of the recess.

The details of one or more implementations are set forth in the accompanying drawings and the description below. Other features will be apparent from the description and drawings, and from the claims.

DETAILED DESCRIPTION

Figure 1A:
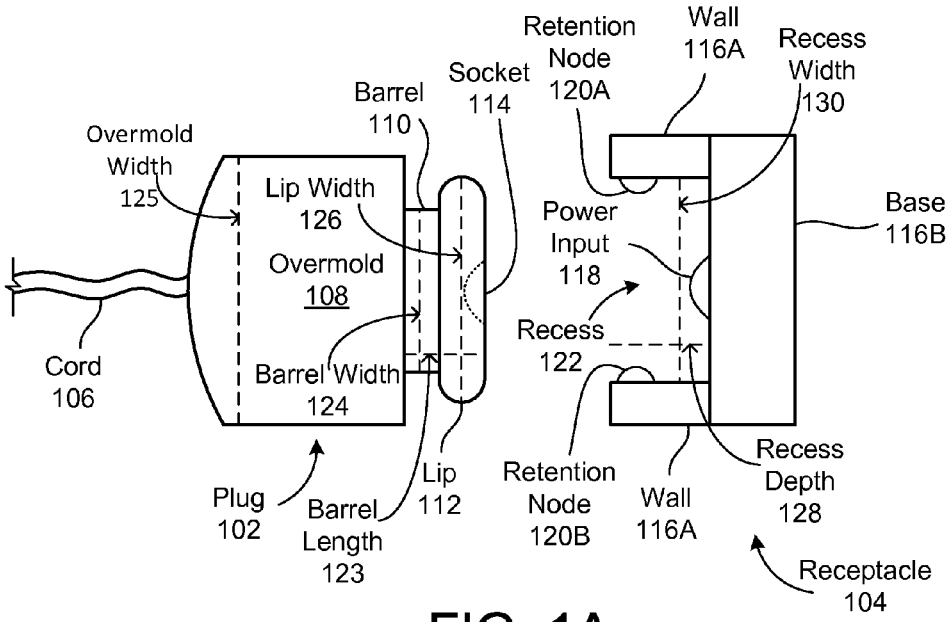
FIG. 1A is a side view of a power connector including a plug and a receptacle.

FIG. 1A is a side view of a power connector including a plug 102 and receptacle 104. The plug 102 may receive electricity or power from a wall outlet, and provide the electricity or power to an electrical device, such as a laptop computer, via the receptacle 104. The plug 102 may be designed so that a portion of the plug 102 which extends into the receptacle 104 is relatively short compared to a width or diameter of the portion of the plug 102 that extends into the receptacle 104. The relative shortness of the portion of the plug 102 extending into the receptacle 104 may allow the plug 102 to easily fall out of the receptacle 104. For example, if a person trips on or otherwise pulls on a power cord 106 extending from the plug 102, the plug 102 may easily fall out of the receptacle 104, without pulling on an electrical device of which the receptacle 104 is a part. This is because, due to the low length-to-diameter (or width) ratio of the portion of the plug 102 that extends into the receptacle 104, when force is applied to the cord 106 in a direction transverse to the length of the cord 106, thus applying a torque to the plug 102 in a direction transverse to a longitudinal axis of the plug 102, the plug 102 may be pulled free of the receptacle 104 without getting caught within the receptacle 104. The ease of the plug 102 falling out of the receptacle 104 may prevent the electrical device from falling off of a table and being damaged.

Figure 4:
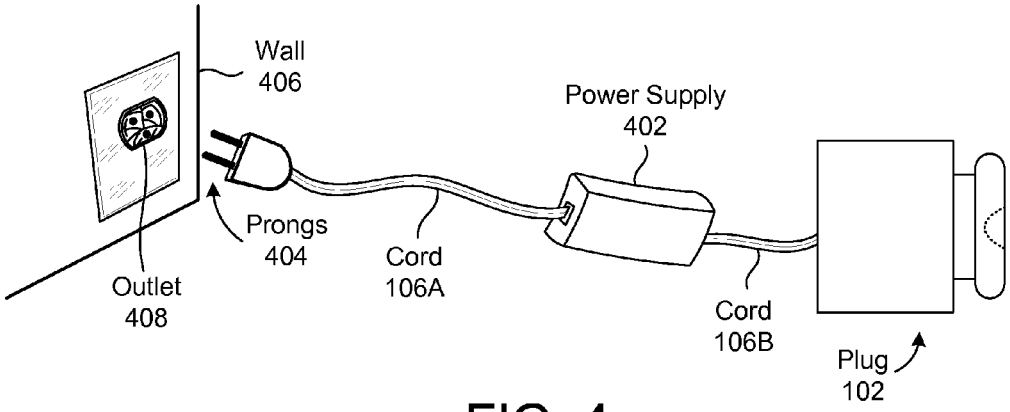
FIG. 4 is a diagram showing the plug as part of an electrical cord, and an electrical power outlet.

A power cord 106 may extend out of the plug 102. The power cord 106 may include a conductive material, such as copper wire, surrounded by a non-conductive material or insulator, such as plastic. The power cord 106 may be coupled to an electrical outlet, as shown in FIG. 4, and electrical current may flow from the outlet, through the conductive material of the power cord 106, and through the plug 102 to the receptacle 104 and the electrical device. The conductive material of the power cord 106 may extend through the plug 102 and contact a conductive portion of the receptacle 104 to provide power to the electrical device. The power cord 106 may include two electrically conductive wires, with one of the wires providing a positive electrical potential to the electrical device, and the other wire providing a negative or ground potential to the electrical device.

The plug 102 may include an overmold 108. The overmold 108 may be made of a non-conductive material or insulator such as plastic or rubber, and may surround or house the conductive material extending from the cord 106. The overmold 108 may be cylindrical, or may be shaped as a rectangular prism or cuboid.

The plug 102 may include a barrel 110 extending from the overmold 108. The barrel 110 may be cylindrical-, rectangular prism-, or cuboid-shaped, according to example implementations. The barrel 110 may be relatively wide, and may have a diameter or minimum width 124 which is at least about two or at least three times a length 123 or depth of the portion of the barrel 110 that extends into the receptacle 104 when the plug 102 is coupled to the receptacle 104. The length 123 of the barrel 110 may also include the distance of the lip 112 from the overmold 108. The barrel 110 may be, for example, about one-half inch wide at its minimum width 124, and one-quarter inch long or deep as measured along the length 123 of the barrel 110.

The conductive material of the power cord 106 may extend through the barrel 110. The conductive material at the end of the power cord 106 and barrel 110 may include a hollow or recessed area, called a socket 114 herein, which may receive a power input 118 of the receptacle 104. The socket 114 may include a recessed area or aperture of the conductive material, and may contact and electrically couple to the power input 118 of the receptacle 104 to provide power to the electrical device. The socket 114 may be relatively shallow, having a depth which is half, or less than half, of the width of the socket 114, allowing the power input 118 to easily contact the bottom or back of the socket 114 without becoming stuck in the socket 114. The barrel 110 may also include a non-conductive material or insulator, such as plastic, surrounding the conductive material (such as the wire) and socket 114, and a conductive material surrounding the non-conductive material or insulator, such as copper or aluminum, which may couple to the ground or negative conductive material or wire of the cord 106 and electrically couple to retention nodes 120A, 120B of the receptacle 104 to ground the electrical device. The non-conductive material and insulator, and the surrounding conductive material, are shown in the front view of the barrel 110 shown in FIG. 3.

Figure 2A:
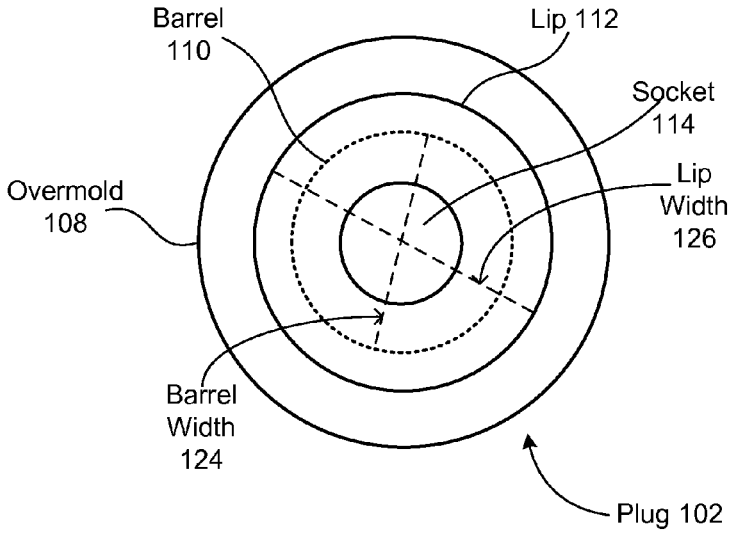
FIG. 2A is a front view of the plug.
Figure 2B:
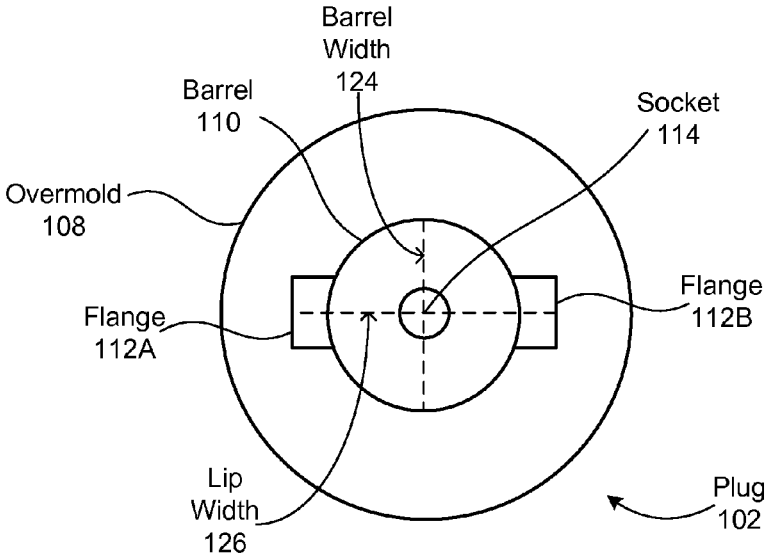
FIG. 2B is a front view of the plug according to an example in which a lip of the plug includes two flanges.

The plug 102 may also include a lip 112 extending from an end portion of the barrel 110. The lip 112 may extend from the barrel 110 in a direction that is generally perpendicular to the direction that the barrel 110 extends from the overmold 108. "Generally perpendicular" may mean ninety degrees, eighty-eight to ninety-two degrees, eighty-five to ninety-five degrees, or eighty to one-hundred degrees from the direction that the barrel 110 extends from the overmold 108, according to example implementations. The lip 112 may be circular, extending around a perimeter or circumference near the end of the barrel 110, or may include two or more tabs or flanges which extend from portions of the barrel 110. A width 126 or diameter of the lip 112, measured from portions of the lip 112 which are farthest from each other, may be greater than the width 124 of the barrel 110. The lip 112 may extend, for example, about one-sixteenth or one-thirty-second of an inch from either side of the barrel 110, making the width 126 of the lip 112 one-eighth or one-sixteenth of an inch greater than the width 124 of the barrel 110. The width 126 or diameter of the lip 112, measured from opposite portions, may be greater than the width or diameter of the barrel 110, but less than, equal to, or no greater than, a width 125 or diameter of the overmold 108. Variations of the lip 112 are shown in FIGS. 2A and 2B.

The lip 112 may be made of an electrically conductive material to electrically couple to the retention nodes 120A, 120B and the outer conductive portion of the barrel 110 to ground the electrical device. The lip 112 may be flexible to pass by and be secured by the retention nodes 120A, 120B. The lip 112 may, for example, be made of bent metal, such as a sheet of metal that is bent into form to extend from the barrel 110, which may include copper or aluminum.

The receptacle 104 may include a housing comprising walls 116A and a base 116B. The housing may be integrated into the electrical device, shown in FIG. 7. The housing may be made of a non-conductive material or insulator, such as plastic or rubber. The walls 116A and base 116B of the housing may enclose, form or include a recess 122. The recess 122 may be cylindrical-, rectangular prism-, or cuboid-shaped, corresponding to the shape of the barrel 110. The recess 122 may be shaped to securely hold the barrel 110 and lip 112, while allowing the barrel 110 and lip 112 to be easily pulled out of the receptacle 104. The width 130 of the recess 122 may be equal to or greater than the width 126 of the lip 112, allowing the lip 112 to move within the recess 122 without becoming stuck between the walls 116A. A depth 128 of the recess 122 may be equal to or less than the length 123 of the barrel 110, and the width 130 of the recess 122 may be two or three times the depth 128 of the recess 122. The lip 112 may be secured within the recess 122 by the retention nodes 120A, 120B, and the retention nodes 120A, 120B may retract in response to sufficiently small pressure to allow the lip 112 to pass by the retention nodes 120A, 120B and the plug 102 to exit the receptacle 104 without pulling the electrical device.

The receptacle 104 may include a power input 118. The power input 118 may extend from the base 116B housing into the recess 122. The power input 118 may extend from the base 116B of the housing into a bottom portion of the recess 122, and may extend from near a center of the base 116B of the housing at the bottom portion of the recess 122. As used herein, the bottom portion of the recess 122 may include the portion of the recess 122 that is enclosed by the base 116B of the housing, and the top portion of the recess 122 may include the portion of the recess 122 near an end of the walls 116A opposite from the base 116B, that is open to receive the plug 102.

Figure 6:
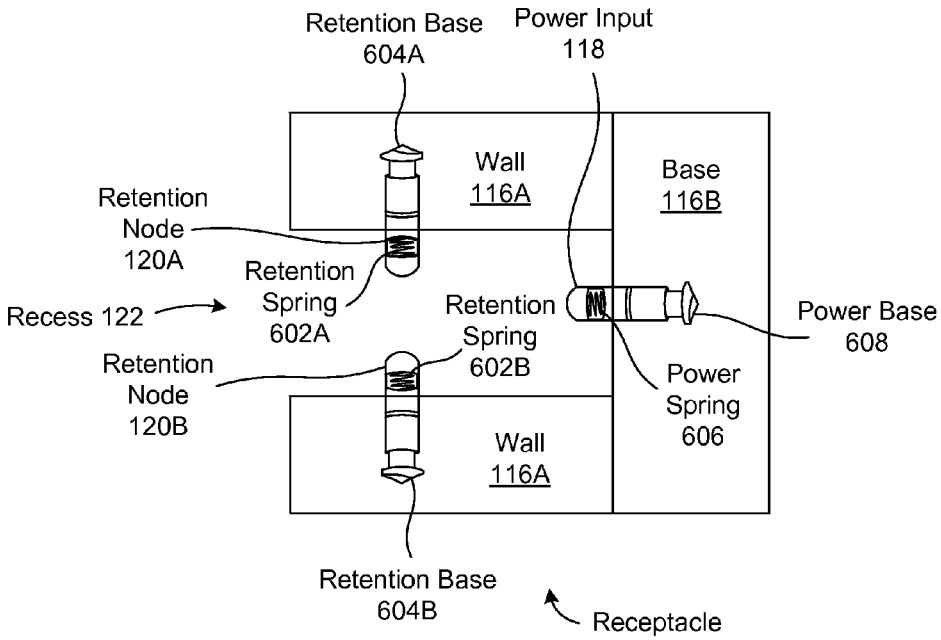
FIG. 6 is a cross-sectional view of the receptacle in an example in which retention nodes and a power input of the receptacle are spring-loaded.

The power input 118 may flexibly extend from the base 116B of the housing into the recess 122. The flexible extension of the power input 118 into the recess 122 may cause the power input 118 to respond to pressure from the socket 114, and/or barrel 110 by retracting into the base 116B of the housing, and respond to the release of the pressure by extending farther out of the base 116B and into the recess 122. The flexible extension of the power input 118 from the base 116B may ensure consistent contact between the power input 118 and the socket 114 or barrel 110 when the plug 102 is inserted into the receptacle 104, maintaining the electrical coupling. A spring may cause the power input 118 to flexibly extend from the base 116B of the housing into the recess 122, an example of which is shown in FIG. 6. The power input 118 may be electrically coupled to a power source of the electrical device, enabling electrical current to flow from the outlet, through the cord 106 and barrel 110, through the power input 118 to the electrical device.

The power input 118 may be dome-shaped. A length of the power input 118, or distance of extension by the power input 118 from the base 116B into the recess 122, may be no greater than, equal to, or less than, half of a width of the power input. The relatively short length of the power input 118 compared to the width of the power input 118, and/or the dome shape of the power input 118, may prevent the power input 118 from becoming caught or stuck inside the socket 114 when the plug 102 is removed from the receptacle 104.

The receptacle 104 may include two or more retention nodes 120A, 120B. The retention nodes 120A, 120B may be located on an inside of the walls 116A of the housing facing the recess 122. The retention nodes 120A, 120B may be at or near a top or opening of the recess 122. The retention nodes 120A, 120B may extend from the walls 116A of the housing into the recess 122 a similar distance that the lip 112 extends from the barrel 110. The retention nodes 120A, 120B may extend, for example, about one-sixteenth or one thirty-second of an inch from the walls 116A of the housing into the recess 122, and the distance between the retention nodes 120A, 120B may be about one-eighth or one-sixteenth of an inch less than the width 130 of the recess 122.

The retention nodes 120A, 120B may be made of an electrically conductive material, such as copper or aluminum. When the plug 102 is inserted into the barrel 104, the retention nodes 120A, 120B may electrically couple to the outer conductive portion of the barrel 110 and/or the lip 112. The retention nodes 120A, 120B may be electrically coupled to a ground or negative node of a battery or other electrical circuit of the electrical device. By the coupling of the retention nodes 120A, 120B to the outer conductive portion of the barrel 110 and/or lip 112, the retention nodes 120A, 120B, conductive portion of the barrel 110 and/or lip 112, and cord 106 may couple a ground or negative node of the battery or other electrical circuit of the electrical device to a ground or negative node of the electrical wall outlet.

The retention nodes 120A, 120B may flexibly extend from the housing 116 into the recess 122. The retention nodes 120A, 120B may be made of an electrically conductive, flexible material, such as bent metal including copper or aluminum as described above with respect to the lip 112. In another alternative, the retention nodes 120A, 120B may flexibly extend from the walls 116A of the housing into the recess 122 with the aid of springs. The springs may cause the retention nodes 120A, 120B to retract away from the recess 122 into the walls 116A of the housing when pressure is applied to the retention nodes 120A, 120B, such as when the lip 112 passes by the retention nodes 120A, 120B when the plug 102 is inserted into or removed from the receptacle 104. The springs may cause the retention nodes 120A, 120B to extend out of the walls 116A of the housing back into the recess 122 when pressure is released from the retention nodes 120A, 120B, such as when the plug 102 is fully inserted into the receptacle 104 or when the plug 102 is removed from the receptacle 104. The springs pressing the retention nodes 120A, 120B into the recess 122 are shown in the cross-sectional view of the receptacle 104 shown in FIG. 6.

Figure 1B:
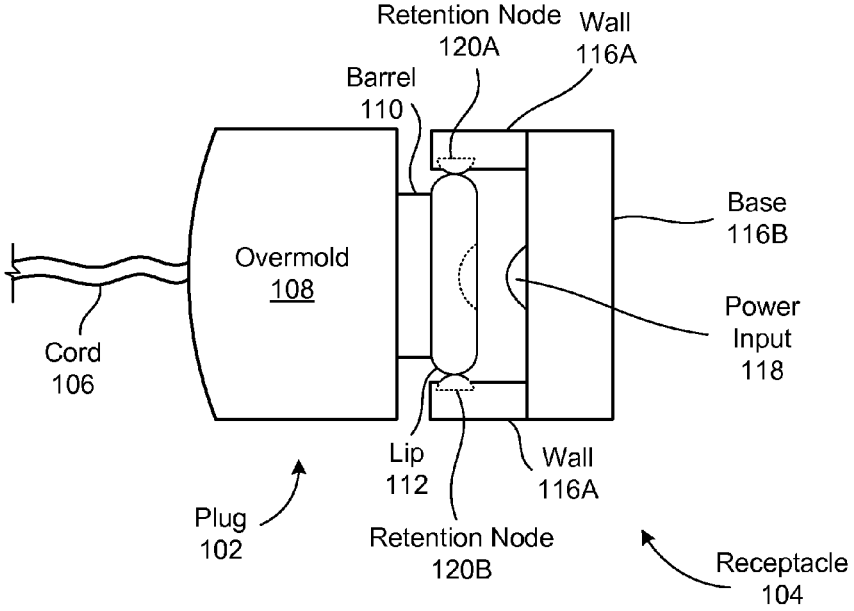
FIG. 1B is a side view of the power connector of FIG. 1A with the plug partially inserted into the receptacle.

FIG. 1B is a side view of the power connector of FIG. 1A with the plug 102 partially inserted into the receptacle 104. As shown in FIG. 1B, the plug 102 is inserted into the receptacle 104 by inserting the barrel 110 into the recess 122. As the barrel 110 is inserted into the recess 122, the lip 112 makes contact with the retention nodes 120A, 120B. The distance across opposite edges of the lip 112 may be greater than a distance between the retention nodes 120A, 120B. As the lip 112 makes contact with the retention nodes 120A, 120B, the greater distance across the opposite edges of the lip 112 than the distance between the retention nodes 120A, 120B may cause the lip 112 to apply pressure to the retention nodes 120A, 120B. The pressure applied to the retention nodes 120A, 120B by the lip 112 may cause the retention nodes 120A, 120B to bend or retract away from a center of the recess 122 and toward or into the walls 116A of the housing. This bending or retracting by the retention nodes 120A, 120B may increase the distance between the retention nodes 120A, 120B, allowing the lip 112 to pass by the retention nodes 120A, 120B, the barrel 110 to enter the recess, and the plug 102 to enter or couple with the receptacle 104. The pressure may also cause the lip 112 to bend, reducing the distance across the lip 112, allowing the lip 112 to pass by the retention nodes 120A, 120B.

Figure 1C:
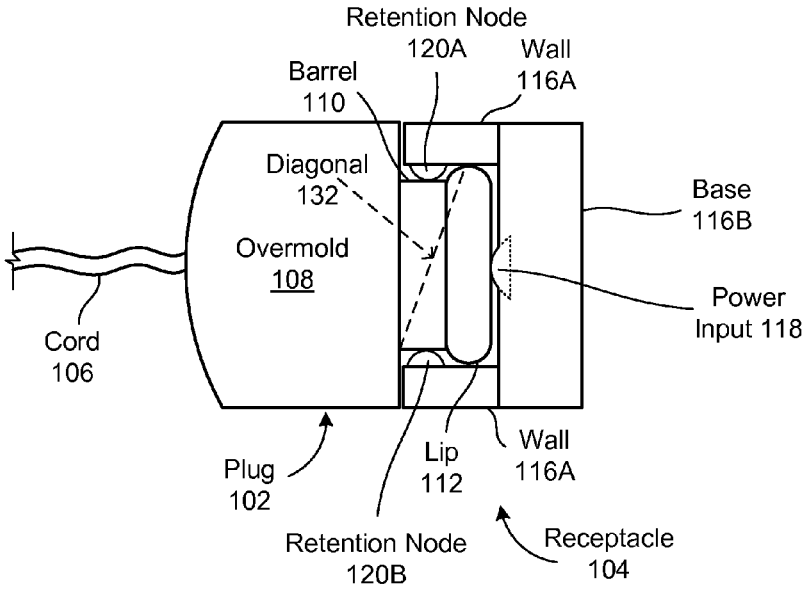
FIG. 1C is a side view of the power connector of FIGS. 1A and 1B with the plug fully inserted into the receptacle.

FIG. 1C is a side view of the power connector of FIGS. 1A and 1B with the plug 102 fully inserted into the receptacle 104. In this view, the lip 112 has passed the retention nodes 120A, 120B so that the barrel 110 is fully inserted into the recess 122 and the plug 102 is fully inserted into the receptacle 104. Because the lip 112 has passed the retention nodes 120A, 120B, the pressure is relieved from the retention nodes 120A, 120B, allowing the retention nodes 120A, 120B to fully extend into the recess 122 from the walls 116A of the housing. With the plug 102 fully inserted into the receptacle 104, the retention nodes 120A, 120B are on an opposite side of the lip 112 from a bottom portion of the walls 116A and the base 116B of the housing, sandwiching the lip 112 between the retention nodes 120A, 120B and the base 116B of the housing, securing the plug 102 into the receptacle 104. However, if the plug 102 is pulled away from the receptacle 104, such as by the cord 106 being pulled on, the plug 102 may easily fall out of the receptacle after applying only a small amount of pressure to any or all of the retention nodes 120A, 120B. The small amount of pressure applied to the retention nodes 120A, 120B may make it unlikely that the electrical device of which the receptacle 104 is a part will be dragged or moved when the plug 102 falls out of the receptacle 104, making it unlikely that a laptop computer, for example, will fall off of a table if the cord 106 is tripped over or otherwise pulled on.

With the plug 102 fully inserted into the receptacle 104, the power input 118 may enter the socket 114. The entry of the power input 118 into the socket 114 may allow the power input 118 to contact the inner conductive portion of the barrel 110, electrically coupling the power source of the electrical device to the conductive portion of the cord 106 and the electrical outlet. The flexibility of the power input 118 may cause the power input 118 to stay in contact with the inner conductive portion of the barrel 110 (which surrounds the socket 114) despite slight movements of the barrel 110 within the recess 122. This flexibility allows the power source of the electrical device to maintain electrical coupling with the electrical outlet despite small movements by the plug 102.

While the plug 102 is fully inserted into the receptacle 104, the outer conductive portion of the barrel 110 and/or lip 112 may be in physical contact with the retention nodes 120A, 120B. The physical contact between the outer conductive portion of the barrel 110 and/or lip 112 and the retention nodes 120A, 120B may electrically couple the outer conductive portion of the barrel 110 and/or lip 112 to the retention nodes 120A, 120B, electrically coupling a ground or negative node of the electrical outlet to the ground or negative node of the power source or battery of the electrical device.

A diagonal 132, measured from points on the opposite sides barrel 110 and lip 112 that are farthest from each other, may represent a side or width of the barrel 110 and lip 112 when the cord 106 and/or overmold 108 is pulled sideways or transversely to the length of the barrel 110 and recess 122. The diagonal 132 may, for example, represent the distance between two points that are farthest from each other on the portion of the plug 102 that is inserted into the recess 122 of the receptacle 104 (i.e. the barrel 110 and lip 112). The length of the diagonal 132 may be no greater than, equal to, or shorter than, the width 130 of the recess 122. With the length of the diagonal 132 being no greater than, equal to, or shorter than, the width 130 of the recess 122, if the cord 106 and/or overmold 108 is pulled sideways or transversely to the length of the barrel 110 and recess 122, the lip 112 may apply pressure to the retention nodes 120A, 120B, but not be held in place by the walls 116A of the receptacle 104.

Figure 1D:
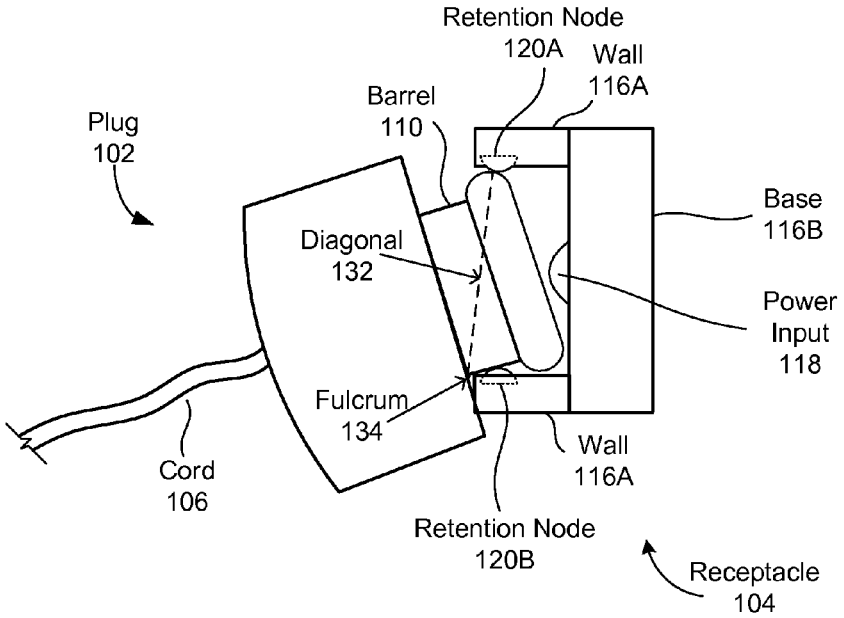
FIG. 1D is a side view of the power connector of FIGS. 1A, 1B, and 1C with the plug being pulled out of the receptacle.

FIG. 1D is a side view of the power connector of FIGS. 1A, 1B, and 1C with the plug 102 being pulled out of the receptacle 104. In this example, a first end or corner of the barrel 110 may act as a fulcrum 134 around which the remainder of the barrel 110 and lip 112 rotate. The diagonal 132 may extend from the fulcrum 134 point of the barrel 110 to an opposite end of the lip 112, or a point on the lip 112 which is farthest from the fulcrum 134 point of the barrel 110. The equal or greater width of the recess 122 compared to the length of the diagonal 132 may allow the barrel 110 and lip 112 to rotate around the fulcrum 134 point of the barrel 110 without becoming stuck in the walls 116A or recess 122 of the receptacle 104. The lip 122 may, while rotating about the fulcrum 134 point of the barrel 110, apply pressure to the retention node 120A which is farther from the fulcrum 134 point of the barrel 110. The pressure on the retention node 120A may cause the retention node 120A to retract into the wall 116A of the housing of the receptacle 104, allowing the plug 102 to fall out of the receptacle 104.

FIG. 2A is a front view of the plug 102. As shown in this example, the overmold 108 has a greater diameter than either the barrel 110 or the lip 112. In this example, the lip 112 is circular, and has a greater diameter or width 126 than the width 124 of the barrel 110. The difference between the width 126 of the lip 112 and the width 124 of the barrel 110 may be no greater than, equal to, or less than, the distance that the retention nodes 120A, 120B extend from the housing 116 into the recess 122 such as, for example, about one-sixteenth of an inch or one-eighth of an inch. The socket 114 may be in a center of the barrel 110 and/or lip 112. The socket 114 may have a relatively smaller diameter than the barrel 110 and lip 112. A depth of the socket 114 may be no greater than, equal to, or less than, half of the diameter of the socket 114, facilitating contact with the inner conductive portion of the barrel 110 (shown in FIG. 3) by the power input 118.

FIG. 2B is a front view of the plug 102 according to an example in which the lip 112 of the plug 102 includes two flanges 112A, 112B. While this example shows two flanges 112A, 112B, the lip 112 may include more than two flanges, such as three, four, or more flanges.

In this example, the two flanges 112A, 112B extend from opposite portions of the barrel 110. If the lip includes more than two flanges 112A, 112B, then the flanges may be evenly spaced around the circumference of the barrel 110. The flanges 112A, 112B may extend beyond the barrel 110 by an amount no greater than, equal to, or less than, the distance that the retention nodes 120A, 120B extend from the housing 116 into the recess 122. The width 126 of the lip 112 may be considered a distance between farthest points of the flanges 112A, 112B.

Figure 3:
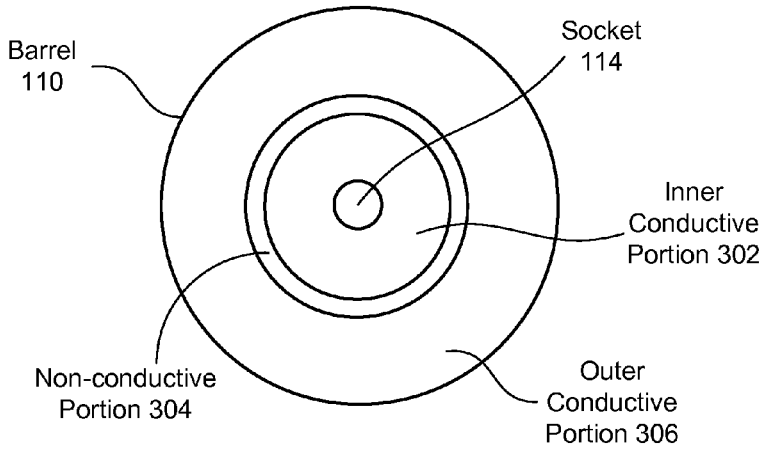
FIG. 3 is a front view of a barrel of the plug.

FIG. 3 is a front view of the barrel 110 of the plug 102. This view does not show the lip 112 so that the conductive and non-conductive portions of the barrel 110 can be shown and explained. As discussed above, the socket 114 may be a recessed portion of the front of the barrel 110. The socket 114 may be surrounded by an inner conductive portion 302. The inner conductive portion 302 of the barrel 110 may carry a positive current or positive power input from the electrical outlet to the electrical device. The inner conductive portion 302 may be physically and electrically coupled to the wire of the cord 106. A non-conductive portion 304, or insulator, such as plastic or rubber, may surround the inner conductive portion 302. The non-conductive portion 304 of the barrel 110 may separate, and prevent electrical coupling between, the inner conductive portion 302 and an outer conductive portion 306 of the barrel 110. The outer conductive portion 306 may surround the non-conductive portion 304, and may extend to the outer surface of the barrel 110. The outer conductive portion 306 may be physically and electrically coupled to a second wire of the cord 106. The outer conductive portion 306 may carry negative current or power input from the electrical outlet to the power supply of the electrical device via the retention nodes 120A, 120B, or may couple a ground node of the power supply of the electrical device to a ground node of the electrical outlet.

FIG. 4 is a diagram showing the plug 102 as part of the electrical cord 106, and an electrical power outlet 408. In this example, the plug 102 may be coupled to a second portion 106B of the cord 106. First and second portions 106A, 106B of the cord 106 may be coupled to both ends of a power supply 402. The power supply 402 may convert alternating current (AC) to direct current (DC). In the example shown in FIG. 4, the power supply 402 may receive AC power from the first portion 106A of the cord 106 on the left of the power supply 402, convert the AC power to DC power, and provide the DC power to the second portion 106B of the cord 106 to the right of the power supply 402. In another example implementation, the power supply 402 may plug directly into the outlet 408 of the wall 406, rendering the first portion 106A of the cord 106 unnecessary.

The first portion 106A of the cord 106 opposite from the plug 102 may be coupled to prongs 404. The prongs 404 may be coupled to the conductive portions of the cord 106, so that the prongs 404 may receive power and provide the power to the electrical device via the cord 106, plug 102, and power input 118. The prongs 404 may be configured to enter an electrical power outlet 408. The electrical power outlet 408 may be located on a wall 406 of a building, or may be located on a power strip, surge protector, or backup battery. The power outlet 408 may be coupled to an electrical power grid, which may provide AC power to the prongs 404, cord 106, and power supply 402.

Figure 5A:
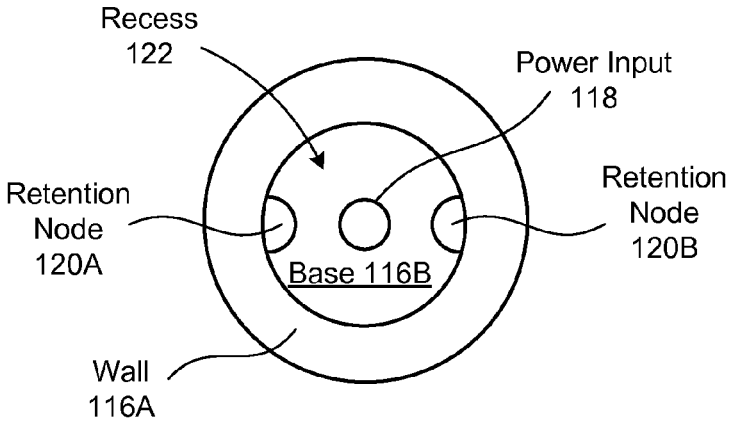
FIG. 5A is a front view of the receptacle.

FIG. 5A is a front view of the receptacle 104. In this example, the housing of the receptacle 104 is circular or cylindrical. The circular or cylindrical shape of the walls 116A of the housing may create the cylindrical recess 122 within the receptacle 104. The retention nodes 120A, 120B may extend inward toward a center of the recess 122 from the inside of the walls 116A of the housing. The power input 118 may extend from the base 116B of the housing.

Figure 5B:
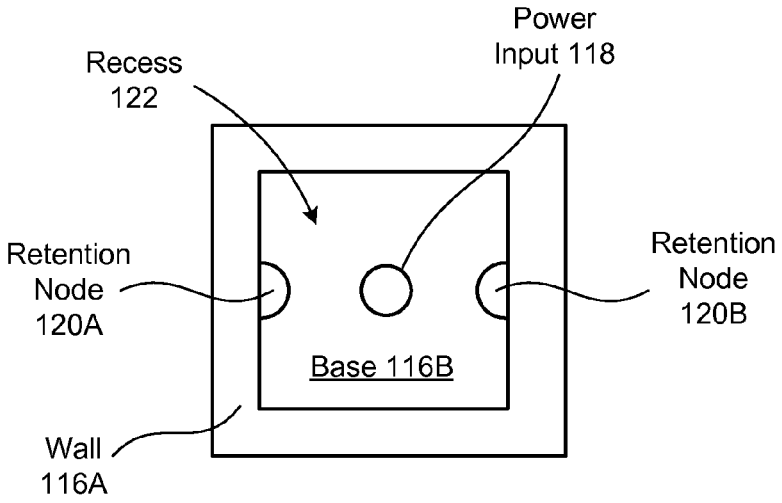
FIG. 5B is a front view of the receptacle according to an example in which a recess of the receptacle is rectangular prism- or cuboid-shaped.

FIG. 5B is a front view of the receptacle 104 according to an example in which the recess 122 of the receptacle 104 is rectangular prism or cuboid-shaped. In this example, the walls 116A of the housing of the receptacle 104 are rectangular, forming a rectangular prism or cuboid recess 122. In this example, as in the circular or rectangular receptacle 104 shown in FIG. 5A, the retention nodes 120A, 120B may extend inward toward a center of the recess 122 from the inside of the walls 116A of the housing, and the power input 118 may extend from the base 116B of the housing at a bottom of the recess 122.

FIG. 6 is a cross-sectional view of the receptacle 104 in an example in which the retention nodes 120A, 120B and the power input 118 of the receptacle 104 are spring-loaded. In this example, the retention nodes 120A, 120B may be generally cylindrical with coned ends extending into the recess 122. The ends of the retention nodes 120A, 120B facing away from the recess 122 may receive retention bases 604A, 604B. The retention bases 604A, 604B may also be cylindrical, and may have capped ends secured to inside portions of the walls 116A of the housing. The retention bases 604A, 604B may enter into the respective retention nodes 120A, 120B. Retention springs 602A, 602B or coils may be inside both the respective retention node 120A, 120B and the respective retention base 604A, 604B. A first end of each retention spring 602A, 602B may be in contact with a cap of the respective retention node 120A, 120B, and an opposite or second end of each retention spring 602A, 602B may be in contact with a base of the respective retention base 604A, 604B. Pressure applied to the retention nodes 120A, 120B may be transferred to the respective retention springs 602A, 602B. The pressure may cause the retention springs 602A, 602B to contract, allowing the retention nodes 120A, 120B to retract into the walls 116A of the housing of the receptacle 104. When the pressure is released, the retention springs 602A, 602B may expand, causing the retention nodes 120A, 120B to extend out of the walls 116A of the housing and into the recess 122.

The power input 118 may be spring-loaded in a similar manner as the retention nodes 120A, 120B. The power input 118 may be cylindrical, with a capped end that may be cone-shaped facing the recess 122. A cylindrical power base 608 may also be cylindrical, and may have a capped end facing away from the power input 118. The capped end may be secured inside the base 116B of the housing. A power spring 606 or coil may extend inside both the power input 118 and the power base 608. Opposite ends of the power spring 606 may be in contact with the capped ends of the power input 118 and the power base 608. The power spring 606 may allow the power input 118 to contract into the base 116B of the housing in response to pressure applied to the power input 118, and may cause the power input 118 to extend back out of the base 116B of the housing into the recess 122 when the pressure is relieved, in similar manner to the retention nodes 120A, 120B described above.

Figure 7:
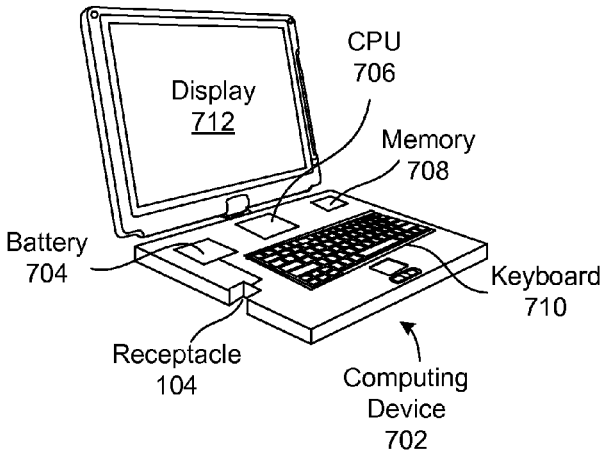
FIG. 7 is a computing device including the receptacle.

FIG. 7 is a computing device 702 including the receptacle 104. The computing device 702, which may be a laptop or netbook computer, a tablet computer, or slider computer, is an example of the electrical device described above. A power source of the computing device, such as a rechargeable battery 704, may receive power from the electrical power outlet 408 (shown in FIG. 4) via the receptacle 104. The receptacle 104 may receive the plug 102 (shown in FIGS. 1A, 1B, 1C, 2A, 2B, 3, and 4), which may be coupled to the power outlet 408. The respective shapes of the plug 102 and receptacle 104 may allow the plug 102 to fall out of the receptacle 104 if the plug 102, or cord 106 connected thereto, is pulled sideways, without also pulling the computing device 702 along with the plug 102.

The battery 704 may provide power to a central processing unit (CPU) 706 of the computing device 702, to a memory 708 of the computing device 702, to an input device such as a keyboard 710 of the computing device 702, and to an output device such as a display 712 of the computing device 702. The battery 704 may also provide power to other components of the computing device 702 not shown in FIG. 7.

Figure 8:
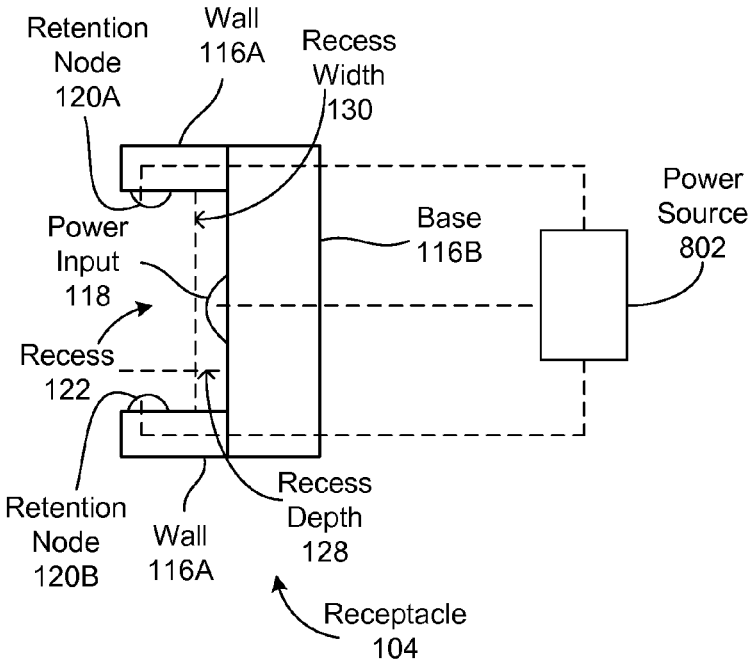
FIG. 8 is a side view of the receptacle and a power source.

FIG. 8 is a side view of the receptacle 104 and a power source 802.

A number of implementations have been described. Nevertheless, it will be understood that various modifications may be made without departing from the spirit and scope of the invention.

What is claimed is:

1. An electrical device comprising:

a housing forming a recess configured to receive a plug, the housing including at least two pairs of parallel walls defining the recess and a base closing one end of the recess;

at least two retention nodes, the retention nodes being flexible and conductive and extending from opposite walls of the housing into the recess, the retention nodes being coupled to a node of a power source of the electrical device; and a power input extending from the base of the housing into the recess, the power input having a length of protrusion into the recess no greater than half of a width of the power input, wherein a relative length of the power input compared to the width of the power input prevents the power input from becoming stuck inside a socket of the plug when the plug is removed from the electrical device.

2. The electrical device of claim 1, wherein the retention nodes extend one-eighth of an inch or less from the walls of the housing.

3. The electrical device of claim 1, further comprising springs coupled to the retention nodes, the springs applying pressure to the retention nodes to press the retention nodes out of the housing and into the recess.

4. The electrical device of claim 1, wherein the at least two retention nodes are adapted to secure the plug within the recess.

5. The electrical device of claim 1, wherein a width of the recess from one wall to an opposite wall is at least twice a depth of the recess from the base to an opposite end of the recess.

6. The electrical device of claim 1, wherein the power input is coupled to a second node of the power source of the electrical device.

7. The electrical device of claim 6, wherein the power input is configured to retract into the housing in response to pressure.

8. The electrical device of claim 6, further comprising a coil pressing the power input out of the base and into the recess.

9. The electrical device of claim 6, further comprising:

a rechargeable battery coupled to the power input; and a ground node coupled to the retention nodes.

10. The electrical device of claim 1, wherein the power input is dome-shaped.

11. An electrical device comprising:

a housing forming a recess configured to receive a plug, the housing including walls surrounding the recess and a base closing one end of the recess, a width of the recess from one wall to an opposite wall being at least twice a depth of the recess from the base to an opposite end of the recess;

a power input at the base extending into the recess, the power input being coupled to a first node of a power source of the electrical device; and at least two retention nodes, the at least two retention nodes being flexible and conductive and extending from opposite walls of the housing into the recess, the retention nodes being coupled to a second node of the power source of the electrical device, wherein a relative shortness of the recess allows the plug to easily fall out of the recess.

12. The electrical device of claim 11, wherein the recess is cylindrical.

13. The electrical device of claim 11, wherein the power input is configured to retract in response to pressure.

14. The electrical device of claim 11, wherein the power input is coupled to a spring.

15. The electrical device of claim 11, wherein the first node of the power source includes a positive power node and the second node of the power source includes a ground node.

16. The electrical device of claim 11, further comprising a spring pressing the power input out of the base and into the recess.

17. The electrical device of claim 11, wherein the retention nodes extend one-eighth of an inch or less from the walls into the recess.

18. An electrical device comprising:

a housing forming a recess configured to receive a plug, the housing including at least two pairs of parallel walls defining the recess and a base closing one end of the recess;

at least two retention nodes, the retention nodes comprising coils and extending from opposite walls of the housing into the recess, the retention nodes being coupled to a node of a power source of the electrical device; and a power input extending from the base of the housing into the recess, the power input comprising a coil.

* * * * *